United States Patent [19]

Sasaki et al.

[11] Patent Number: 4,791,876

[45] Date of Patent: Dec. 20, 1988

[54] AUTOMATIC NEEDLE THREAD SUPPLY CONTROL SYSTEM

[75] Inventors: Toshio Sasaki; Masao Ogawa, both of Nagoya, Japan

[73] Assignee: Brother Kogyo Kabushiki Kaisha, Aichi, Japan

[21] Appl. No.: 16,332

[22] Filed: Feb. 19, 1987

[30] Foreign Application Priority Data

Feb. 22, 1986 [JP] Japan ..... 61-37898
Oct. 22, 1986 [JP] Japan ..... 61-25133

[51] Int. Cl.[4] ..... D05B 49/00

[52] U.S. Cl. ..... 112/241; 112/255; 112/302

[58] Field of Search ..... 112/254, 255, 241, 242, 112/243, 244, 245, 273, 278, 302, 97, 59, 250, 246, 221

[56] References Cited

U.S. PATENT DOCUMENTS 4,215,641 8/1980 Dobrjanskyj et al. ..... 112/255 X
4,246,857 1/1981 Gonnai ..... 112/254
4,408,554 10/1983 Takiguchi et al. ..... 112/243 X
4,632,048 12/1986 Matsubara ..... 112/255 X
4,638,751 1/1987 Hanyu et al. ..... 112/254
4,690,083 9/1987 Hara et al. ..... 112/254

FOREIGN PATENT DOCUMENTS 53-41580 11/1978 Japan .
58-10115 2/1983 Japan .
60-19278 5/1985 Japan .

*Primary Examiner*—Peter Nerbun
*Attorney, Agent, or Firm*—Barnes and Thornburg

[57] ABSTRACT

In a conventional sewing machine, as the take-up lever is driven by the take-up lever crank, the take-up lever does not keep its uppermost position during the feed motion of a work fabric. Accordingly, the length of the thread path extending from the thread supply source to the eye of the needle varies remarkably during feed motion, and thus the needle thread equivalent to the amount consumed by stitch feed motion cannot be extracted from the supply source. In the present automatic needle thread supply control system, during a specific period from a time before finishing of each feed motion to a time when the needle reaches the throat plate, the take-up lever is held at its uppermost position. During a given period corresponding to the comparatively latter half of the specified period, thread supply stopping is released, whereby the needle thread equivalent to the amount consumed by each stitch feed motion can be extracted certainly from the supply source toward the take-up lever. The present thread supply control system comprises, at least, thread securing means or driving means, thread supply stopping means and mechanical control means.

12 Claims, 10 Drawing Sheets

AUTOMATIC NEEDLE THREAD SUPPLY CONTROL SYSTEM

BACKGROUND OF THE INVENTION

The present invention relates to an automatic needle thread supply control system for a sewing machine having a thread take-up member which takes up the needle thread in synchronism with the vertical reciprocatory motion of the needle and, more specifically, to an automatic needle thread supply control system having a pair of thread clamping members disposed between the thread supply source and the thread take-up member in the thread supply path extending from the thread supply source to the needle, for clamping and releasing the needle thread.

There have been proposed, to form satisfactory stitches, various sewing machines in which the thread supply is controlled so that points of interlock of the needle thread and the bobbin thread are located at the middle of the thickness of the fabric being sewn. Such a sewing machine disclosed, for example, in Japanese Patent Publication No. 58-10115 comprises a needle thread supply controller capable of temporarily releasing the needle thread to remove tension from the needle thread, and a detecting device for detecting the motion of the tension detector and actuating the needle thread supply controller, in which the needle thread supply controller releases the needle thread upon the arrival of the point of interlock of the needle thread and the bobbin thread at the middle of the thickness of the fabric being sewn. Another sewing machine disclosed in Japanese Patent Publication No. 60-19278 comprises an electromagnetic needle thread gripper disposed between the take-up lever and the needle, in which the needle thread gripper grips the needle thread to simultaneously stop pulling up the bobbin thread and to draw out the needle thread upon the arrival of the point of interlock of the needle thread and the bobbin thread at the middle of the thickness of the fabric being sewn.

In the known prior sewing machines described hereinbefore, however, the arrival of the point of interlock of the needle thread and the bobbin thread at the middle of the thickness of the fabric being sewn is not detected directly. Therefore, it is necessary, to locate the point of interlock of the needle thread and the bobbin thread accurately at the middle of the thickness of the fabric being sewn, that various factors which affect the needle thread tension, such as the type of fabric, the thickness of fabric, the type and thickness of thread, the width and length of stitch, and the type of pattern, are determined beforehand, the supply of the needle thread is calculated on the basis of those given factors, and the supply of the needle thread is controlled according to the result of the calculation. Accordingly, the sewing machine needs detectors for detecting those factors which affect the needle thread tension, and an arithmetic unit for calculating the supply of the needle thread on the basis of the results of the detection, and hence the sewing machine inevitably becomes complex and expensive.

A needle thread supply control system to obviate such inconveniences is disclosed, for example, in Japanese Patent Publication No. 53-41580. In this needle thread supply control system, a pair of tension discs are controlled by an actuator of the solenoid type for clamping and releasing the needle thread. The actuator is driven in synchronism with the main shaft of the sewing machine so as to permit the supply of the needle thread in a predetermined period in one stitching cycle and check the supply of the needle thread in the rest of the period. While the tension discs are released, the needle thread is supplied without restraint so that the supply of the needle thread is dependent only on the normal stitching conditions, such as the type of the fabric, stitch length and the type of pattern. After the needle thread has been supplied according to such normal stitching conditions, the tension discs are pressed together to check the supply of the needle thread in order to prevent the disarrangement of the stitch formed while the needle thread is supplied according to the normal stitching conditions. Thus, the needle thread supply control system eliminates the tension detector for detecting the tension of the needle thread and the device for calculating the supply of the needle thread, and hence simplifies the general constitution of the sewing machine.

However, this needle thread supply control system still has disadvantages. While the tension discs are released to supply the needle thread without restraint, the take-up lever swings from the uppermost position downward in synchronism with the vertical reciprocative motion of the needle. Consequently, part of the needle thread stored by the loop taker when the take-up lever is at the uppermost position is used as part of the needle thread necessary for forming the stitch. Accordingly, when the take-up lever returns to the uppermost position after the needle thread and the bobbin thread have been interlocked, an excessively high tension proportional to the length of the needle thread and used for forming the stitch among the length of the same stored by the loop taker is exerted on the needle thread; consequently, the bobbin thread is pulled out on the surface of the fabric being sewn deteriorating the quality of the stitch.

SUMMARY OF THE INVENTION

It is therefore an object of the present invention to provide an automatic needle thread supply control system capable of accurately controlling the supply of the needle thread so that the point of interlock of the needle thread and the bobbin thread is always located within the fabric being sewn irrespective of the variation of the thickness of the fabric being sewn.

It is another object of the present invention to provide an automatic needle thread supply control system capable of controlling the needle thread tension at an optimum level according to the thickness of the fabric being sewn.

It is a further object of the present invention to provide an automatic needle thread supply control system capable of releasing and clamping the needle thread silently and surely.

The foregoing objects are attained according to the principle of the present invention. The first embodiment of the invention is in combination with a sewing machine having a needle thread supply source, an endwise reciprocatory needle with an eye, a feed member operating in synchronism with the reciprocation of the needle for imparting a feed motion to a work fabric, a take-up member movable between a first position where the needle thread is slackened to a maximum thread slack amount and a second position where the needle thread is taken up to a maximum thread take-up amount, and a needle thread supply path extending from the needle thread supply source through the take-up member to the eye of the needle, by providing an automatic needle thread supply control system comprising: thread securing means operative in synchronism with the reciprocation of the needle for securing the maximum thread take-up amount of the needle thread during a specific period which starts at a time determined so as to at least partly overlap with the period of the feed motion and terminates at a time when the eye of the needle is lowered near to the surface of a bed; thread supply stopping means operative to permit and check the supply of the needle thread which is drawn out from the needle thread supply source as the fabric is fed by the feed member; and control means operative in synchronism with the reciprocation of the needle for controlling the timing and the period of operation of the thread supply stopping means according to the thickness of the fabric being sewn or the thickness of the needle thread being used so that the thread supply stopping means permits the supply of the needle thread during the specific period.

The second embodiment of the invention is in combination with a sewing machine having the same constitution as that of abovementioned first invention, by providing an automatic needle thread supply control system comprising: driving means for timing the start of holding the take-up member at the second position so that the period of holding the take-up member at the second position at least partly overlaps with the period of the feed motion, holding the take-up member at the second position until the eye of the needle is lowered near to the surface of a bed, and moving the take-up member in synchronism with the reciprocation of the needle after the eye of the needle has been lowered near to the surface of the bed; thread supply stopping means operative to permit and check the supply of the needle thread which is drawn out from the needle thread supply source as the fabric is fed by the feed member; and control means operative in synchronism with the reciprocation of the needle for controlling the timing and the period of operation of the thread supply stopping means according to the thickness of the fabric being sewn or the thickness of the needle thread being used so that the thread supply stopping means permits the supply of the needle thread while the take-up member is held at the second position.

According to the present invention, the control means determines the timing of actuation and the period of operation of the thread supply stopping means according to the thickness of the fabric or the thickness of the needle thread every vertical movement of the needle and, while being actuated, the thread supply stopping means permits the free supply of the needle thread from the thread supply source to the take-up member. During the free supply of the needle thread, the take-up member is held at the maximum thread take-up position (second position), and thereby the fixed length of the thread stored by the loop taker is secured without being used for forming a stitch. Consequently, an optimum length of the needle thread spontaneously determined according various stitching conditions, such as the type of fabric and stitch length, is supplied from the thread supply source. After the period of actuation of the thread supply stopping means has elapsed the take-up member starts its motion in phase with the vertical reciprocatory motion of the needle upon the arrival of the eye of the needle at a position near the surface of the bed. As the take-up member moves toward the maximum thread slackening position (first position), the needle thread is supplied to the loop taker, and then the needle thread and the bobbin threads are interlocked through the known motion of the loop taker. The point of interlock of the needle thread and the bobbin thread is completed at a moment when the take-up member arrives at the maximum thread take-up position after the needle thread and the bobbin thread has been interlocked.

Preferably, the thread supply stopping means comprises a pair of thread clamping members having clamping surfaces which engage in point contact to surely clamp the needle thread.

Preferably, the control means comprises proportional control means operatively connected to the main shaft of the sewing machine to control the speed of at least either a motion for engaging or a motion for disengaging the thread clamping members of the thread supply stopping means in proportion to the rotating speed of the main shaft of the sewing machine.

If need be, the proportional control means may comprise a rotary member operatively connected to the main shaft of the sewing machine, a detector for generating a pulse signal every predetermined angle of rotation of the rotary member, and actuating means for varying the relative position of the thread clamping members in response to the pulse signal at least either in engaging or in disengaging the thread clamping members.

The proportional control means engages and disengages the thread clamping members through a smooth and continuous motion at a speed proportional to the rotating speed of the main shaft of the sewing machine. Accordingly, the phase of clamping the needle thread and the phase of releasing the needle thread vary according to the thickness of the needle thread. That is, a thick needle thread, as compared with a thin needle thread, is clamped at an earlier phase and is released at a later phase, and hence a thick needle thread of a less length is supplied for forming a stitch, so that a higher tension is exerted on the loop to tighten the loop, where as a thin needle thread of a more length is supplied and a lower tension is exerted to the thin needle thread for tightening the loop. Thus, the tension of the needle thread is controlled stably according to the thickness of the needle thread and the rotating speed of the main shaft of the sewing machine.

The third embodiment of the inventon is in combination with a sewing machine having a needle thread supply source, an endwise reciprocatory needle with an eye, a take-up member movable between a maximum thread slack position and a maximum thread take-up position, and a needle thread supply path extending from the needle thread supply source through the take-up member to the eye of the needle, by providing an automatic needle thread supply control system comprising: a pair of thread clamping members movable toward and away from each other for checking and permitting the supply of the needle thread from the needle thread supply source toward the take-up member; and proportional control means for controlling the speed of at least either a motion for engaging or a motion for disengaging the thread clamping members in proportion to a sewing speed; whereby the timing and the period of checking and permitting the supply of the needle thread are automatically changed according to the thickness of the needle thread being used.

If need be, the proportional control means may comprise a cam member operatively connected to the main shaft of the sewing machine and a cam follower engageable with the cam member and operatively connected to one of the thread clamping members.

The fourth embodiment of the invention is in combination with a sewing machine having a needle thread supply source, an endwise reciprocatory needle with an eye, and a needle thread supply path extending from the needle thread supply source and to the eye of the needle and including at least one bent portion, by providing an automatic needle thread supply control system comprising: a pair of thread contacting members located at the bent portion of the needle thread supply path and movable toward and away from each other in a specific direction which is substantially parallel to a plane including the needle thread supply path about the bent portion; and control means for controlling the movement of the thread contacting members to vary an amount of the needle thread to be supplied toward the eye of the needle.

DESCRIPTION OF THE PREFERRED EMBODIMENTS

Preferred embodiments of the present invention will be described hereinafter with reference to the accompanying drawings.

First Embodiment (FIGS. 1 to 6):

Constitution

Figure 6:
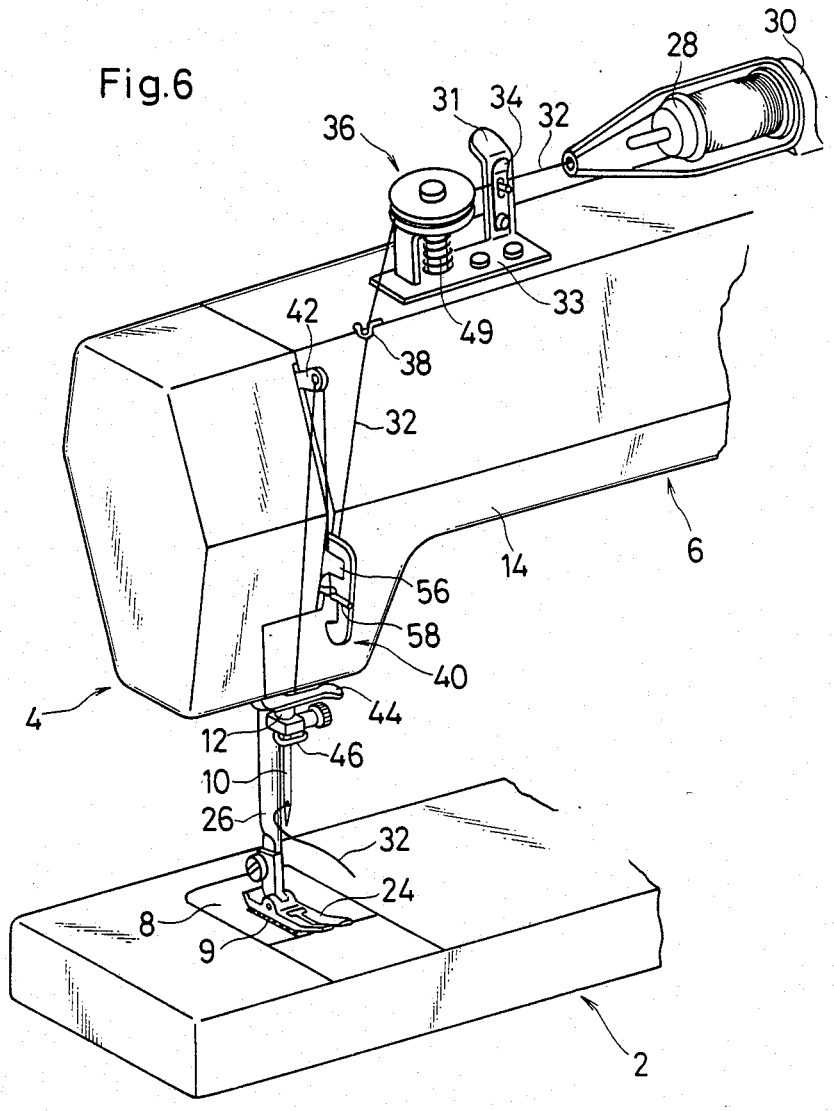
FIG. 6 is a fragmentary perspective view of the head and the associated parts of the sewing machine incorporating the embodiment.

Referring to FIG. 6, a sewing machine has a work supporting bed 2, a standard (not shown) standing on the work supporting bed 2, and an arm 6 supporting by the standard so as to over hang horizontally over the work supporting bed 2 and provided at the free end thereof with a head unit 4. A needle bar 12 is provided in the head unit 4 so as to be driven by a swing mechanism (not shown) for lateral jogging motion, and by an arm shaft 22 for vertical reciprocatory motion. A feed dog 9 is moved upward through slots formed in a throat plate 8 provided on the work supporting bed 2 by a feed mechanism (not shown) to feed a work fabric 37. Predetermined stitches are formed in the work fabric 37 through the cooperative motion of the needle bar 12 and the feed dog 9.

Figure 1:
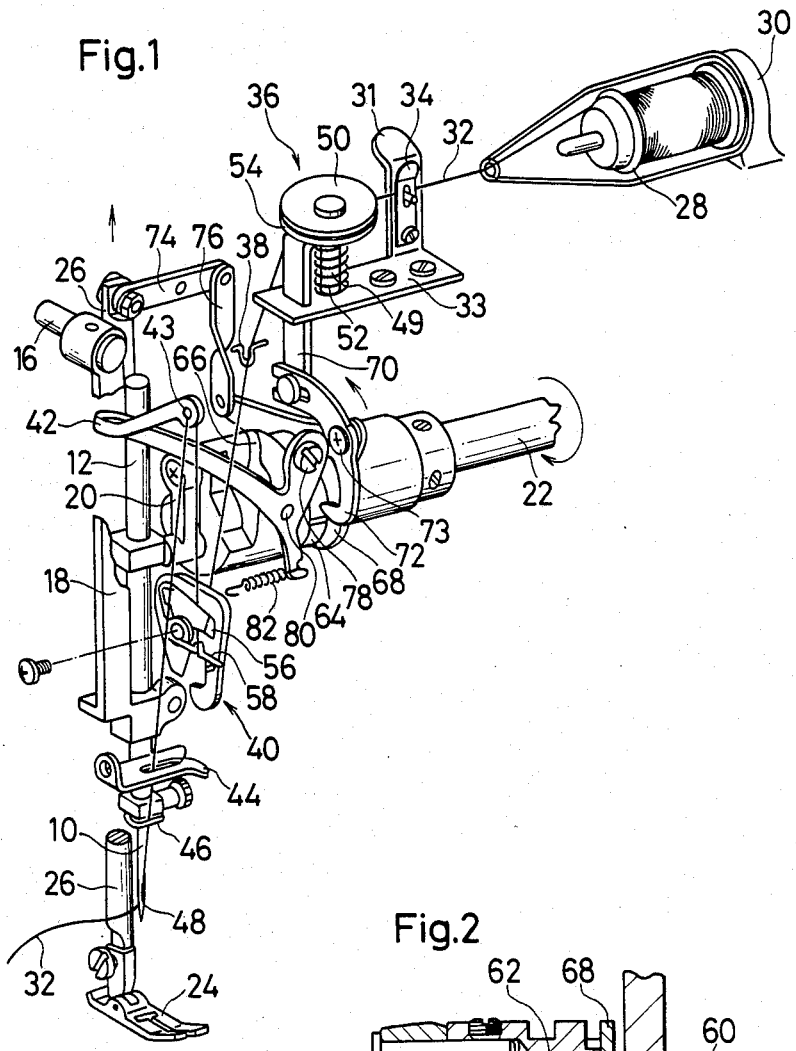
FIG. 1 is a perspective view of the essential portion of an automatic needle thread tension control system, in a preferred first embodiment, according to the present invention incorporated into a sewing machine.

Referring now to FIG. 1, the needle bar 12 holding a needle 10 at the lower end thereof is supported vertically movably by a needle bar guide 18 pivotally supported on a pin 16 fixed to the frame 14 (not shown in FIG. 1) of the sewing machine. The needle bar 12 is driven for vertical motion through a crank arm 20 by the arm shaft 22. A presser bar 26 holds a presser foot 24 at the lower end thereof, and is moved between an upper position and a lower position by a mechanism (not shown). The presser bar 26 is mounted on the frame 14. When the presser bar 26 is located at the lower position, the presser foot 24 exerts a pre-determined pressure to the work fabric 37.

A needle thread holder 30 holding a needle thread spool 28, i.e., a needle thread supply source, and a base plate 33 supporting a guide plate 31 and a needle thread clamping device 36 are fixed to the upper surface of the head unit 4 of the frame 14. A needle thread 32 drawn out from the needle thread spool 28 is threaded sequentially through a pre-tension spring plate 34 fixed to the guide plate 31, the needle thread clamping device 36, a first guide 38, and a second guide 40 to a guide hole 43 formed in the free end of a take-up lever 42, and then further through a third guide 44 fixed to the frame 14, and a fourth guide 46 fixed to the needle bar 12 and finally to the eye 48 of the needle 10. The pre-tension spring plate 34 resiliently applies a predetermined sliding resistance to the needle thread 32. The needle thread clamping device 36 functions as the thread supply stopping means of the present invention. The needle thread clamping device 36 comprises a bar 49 fixed to the base plate 33, an upper disc 50 supported by the bar 49, a lower disc 54 disposed opposite to the upper disc 50, and a spring 52 biasing the lower disc 54 toward the upper disc 50. The needle thread 32 is clamped between the upper disc 50 and the lower disc 54 to stop the supply of the needle thread 32. In this embodiment, the upper disc 50 and the lower disc 54 functions as the needle thread clamping members, the spring 52 functions as the elastic member for engaging the needle thread clamping members, and a connecting member 70 functions as the releasing member for releasing the needle thread 32 from the needle thread clamping members.

The second guide 40 is provided with a pre-tension spring plate 56 and a spring arm 58 to apply a predetermined sliding resistance to the needle thread 32 and to prevent the needle thread 32 from being broken when the tension on the needle thread is increased temporarily. The maximum tension that is exerted on the needle thread 32 is limited, for example, to a tension between the breaking tension of a 30/1 cotton thread and a tension required for forming satisfactory stitches in sewing denim of 5 mm in thickness. Thus, spring arm 58 functions as a buffer.

Figure 2:
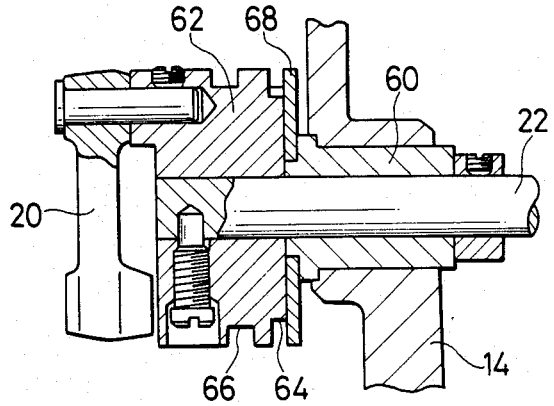
FIG. 2 is a sectional view showing a mechanism mounted on one end of the main shaft of the sewing machine shown in FIG. 1.

As illustrated in FIG. 2, the arm shaft 22 is supported rotatably at one end in a bearing bush 60 on the frame 14, and a cam member 62 is fixedly mounted on the arm shaft 22 near the end of the same. A first annular groove 64 and a second annular groove 66 are formed in the circumference of the cam member 62. The bottom surface of the first annular groove functions as a first cam for controlling the needle thread clamping device 36. The second annular groove 66 is a groove cam hainv a side wall functioning as a second cam for controlling the motion of the take-up lever 42. The first and second cams are designed so as to control the needle thread clamping device 36 and the take-up lever 42, respectively, for motions indicated by motion curves in FIG. 3. A needle thread clamp control plate 68 is mounted on the arm shaft 22 for rotation relative to and coaxially with the arm shaft 22 between the cam member 62 and the bearing bush 60.

A control lever 72 is pivotally attached to the needle thread clamp control plate 68 with a pin 73. The control lever 72 has one end placed in sliding contact with the bottom surface of the first annular groove 64, and the other end connected by the connecting member 70 to the upper disc 50. The control plate 68 is connected to the presser bar 26 by a first link 74 and a second link 76, and hence the control plate 68 does not rotate together with the arm shaft 22. Since the control lever 72 is caused to swing by the first cam of the first annular groove 64 as the arm shaft 22 rotates; consequently, the needle thread clamping device 36 is driven in phase with the arm shaft 22 for needle thread clamping and releasing motion as represented by the motion curve in FIG. 3. The first link 74 is joined pivotally at the central portion thereof to the frame 14 with a pin (not shown). When the presser foot 24 is lowered to press the work fabric 37, the control plate 68 is turned by an angle corresponding to the thickness of the work fabric 37 so that the phases of the needle thread clamping motion and needle thread releasing motion of the needle thread clamping device 36 are advanced with the increase of the thickness of the work fabric 37. Thus, in this embodiment, a mechanism comprising the needle thread clamp control plate 68 and the first cam of the first annular groove 64 corresponds to the control means for controlling the phases of the needle thread clamping motion and needle thread releasing motion of the needle thread clamping device 36 in relation to the thickness of the work fabric 37.

The take-up lever 42, i.e., the take-up member is joined pivotally at the base end to the frame 14 with a pin 78. A cam follower 80 is fixed to the base end of the take-up lever 42. The cam follower 80 engages the second cam of the second annular groove 66, so that the take-up lever 42 is driven in phase with the arm shaft 22 by the second cam of the second annular groove 66 for vertical motion as represented by the motion curve in FIG. 3. Thus, in this embodiment, the second annular groove 66 corresponds to the take-up member driving means for vertically driving the take-up member. A coil spring 82 is extended between the base end of the take-up lever 42 and the frame 14 so as to bias the take-up lever 42 upward so that the take-up lever 42 is moved smoothly upward.

Figure 3:
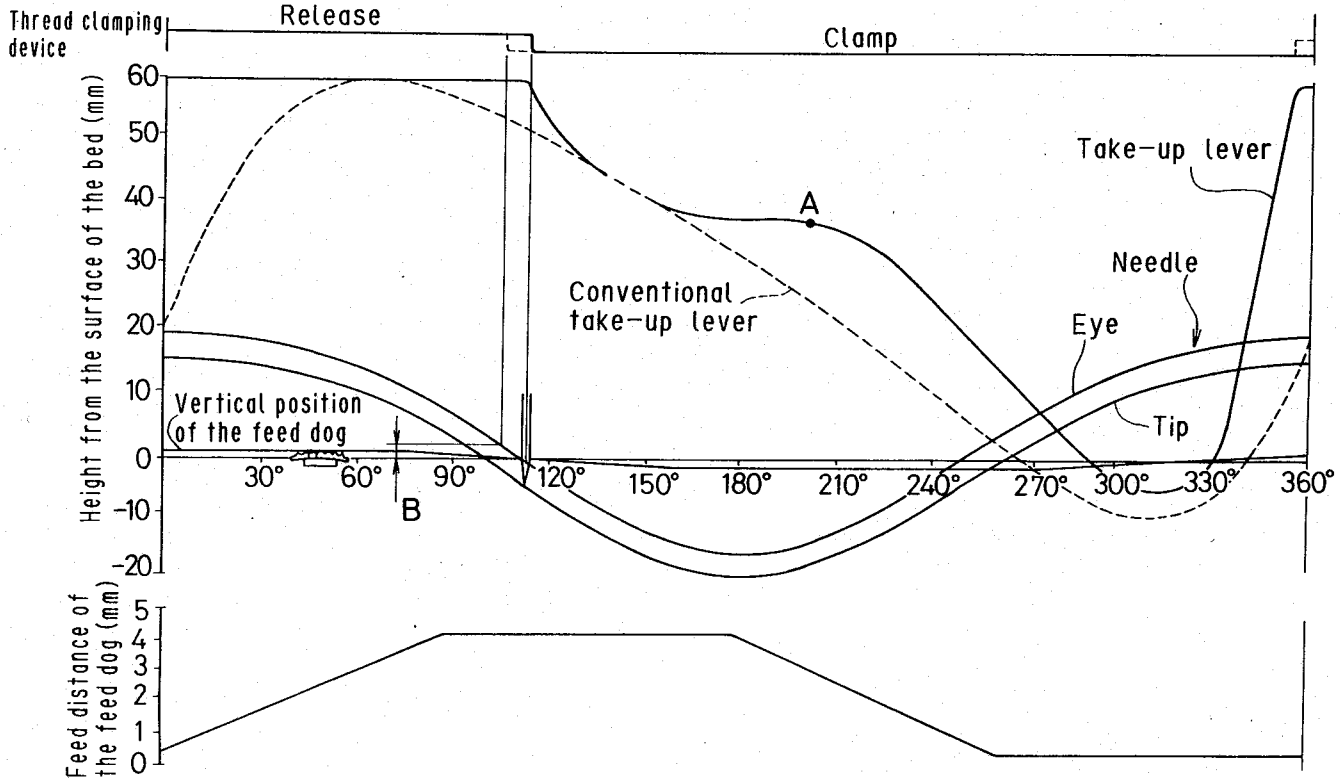
FIG. 3 is a time chart showing the respective motions of the components of the sewing machine under the control of the automatic needle thread tension control system of FIG. 1.

FIG. 3 is a time chart showing the motions of the components of the thus constituted lock stitch sewing machine. In FIG. 3, the phase of the arm shaft 22 is measured by angle of rotation on the horizontal axis.

Function and Effect

Referring to FIG. 3, the needle thread clamping device 36 is controlled in synchronism with the vertical motion of the needle 12 and the feed motion of the feed dog 9 by the first cam formed on the bottom surface of the first annular groove 64. The needle thread 32 is released from the needle thread clamping device 36 during a period between the start of the feed motion of the feed dog 9 and a moment when the eye 48 of the needle 10 arrives at a position near the surface of the bed, namely, a moment when the eye 48 arrives substantially at the middle of the thickness of the work fabric 37. Upon the arrival of the eye 48 of the needle 10 at a position near the surface of the bed, the needle thread clamping device 36 clamps the needle thread 32 to stop the supply of the needle thread 32. On the other hand, while the needle thread 32 is being supplied without restraint, the take-up lever 42 is held at the uppermost position. Thus the needle thread clamping device 36 permits the free supply of the needle thread 32 by an amount corresponding to the downward movement of the eye 48 of the needle 10 to a position near the surface of the bed and the feed of the work fabric 37, while the take-up lever 42 is held at the uppermost position. Accordingly, the needle thread 32 is supplied against a small sliding resistance necessary only to prevent slack in the needle thread 32. After the needle thread 32 has been supplied by the necessary amount without restraint, the needle thread clamping device 36 clamps the needle thread 32 to prevent the excessive supply of the needle thread 32.

After the needle thread 32 has thus been clamped by the needle thread clamping device 36, the take-up lever 42 starts moving downward according to the predetermined motion curve to slacken the needle thread 32 clamped by the needle thread clamping device 36 so that needle thread 32 will not be strained excessively by the downward movement of the needle 10 and the needle thread 32 is able to be interlocked with the bobbin thread 35. Incidentally, in FIG. 3, the movement of the take-up lever 42 from an angle where the needle thread 32 is clamped to an angle corresponding to a point A where the shuttle hook catches a loop of the needle thread corresponds to the half of needle thread demand necessary for the downward movement of the needle bar 12, while the movement of the take-up lever 42 from the point A to an angle where the needle thread 32 is released from the needle thread clamping device 36 corresponds to the half of bobbin thread demand necessary for the motion of the shuttle (not shown).

Figure 4:
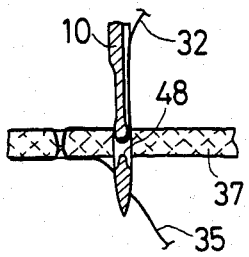
FIGS. 4 and 5 are sectional views showing stitches formed on the sewing machine incorporating the embodiment.

A stitch as illustrated in FIG. 4 is formed through the motions of the needle bar 12, the feed dog 9, the needle thread clamping device 36 and the take-up lever 42 synchronous with the rotation of the arm shaft 22. While the take-up lever 42 is held at the uppermost position, only an actually necessary amount of the needle thread 32 for forming a stitch is supplied without being restrained by the needle thread clamping device 36, and the excessive supply of the needle thread 32 is prevented by the needle thread clamping device 36 after the actually necessary amount of the needle thread has been supplied. Thus, an optimum stitch having the point of interlock of the needle thread 32 and the bobbin thread 35 at the middle of the thickness of the work fabric 37 is formed.

Figure 5:
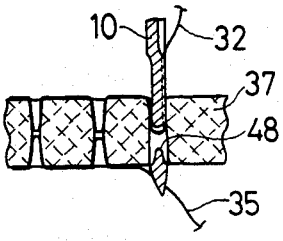

Since the height of the presser bar 26 at a position where the presser foot 24 is pressing the work fabric 37 is dependent on the thickness of the work fabric 37, the phase of operation of the needle thread clamping device 36 is advanced with the increase of the thickness of the work fabric 37 as indicated by broken line in FIG. 3. Accordingly, as illustrated in FIG. 5, the point of interlock of the needle thread 32 and the bobbin thread 35 is located at the middle of the thickness of the work fabric 37 regardless of the thickness of the work fabric 37. The broken line in FIG. 3 indicates the operation of the needle thread clamping device 36, for example, when the thickness of the work fabric 37 is on the order of 5 mm, in which the needle thread clamping device 36 clamps the needle thread 32 upon the arrival of the eye 48 of the needle 10 at a position at a height of about 2.5 mm (a height B in FIG. 3) from the surface of the bed. The motion curve of the needle thread clamping device 36 indicated by continuous line in FIG. 3 represents the action of the needle thread clamping device 36 when the thickness of the work fabric 37 is almost zero, in which the needle thread clamping device 36 clamps the needle thread 32 upon the arrival of the eye 48 of the needle 10 on a level flush with the surface of the bed.

Thus, the needle thread clamping device 36 permits the free supply of the needle thread 32 and the take-up lever 42 is held at the uppermost position while the needle thread 32 is being supplied by an amount actually necessary for forming a stitch, and then the needle thread clamping device 36 stops the supply of the needle thread 32 after the needle thread 32 has been supplied by the actually necessary amount to prevent the excessive supply of the needle thread 32. Furthermore, the phase of the needle thread clamping operation of the needle thread clamping device 36 is regulated according to the thickness of the work fabric 37. Consequently, an optimum stitch having the point of interlock of the needle thread 32 and the bobbin thread 35 at the middle of the thickness of the work fabric 37 is formed regardless of various conditions affecting the tension of the needle thread, such as the type of the work fabric 37, the type and thickness of the needle thread 32 or the bobbin thread 35, the width and length of stitch, and the type of pattern.

Still further, there is provided with the spring arm 58 of the second guide 40 which yields to an excessively high tension, and thereby the needle thread 32 is prevented from being broken by an excessive tension temporarily exerted on the needle thread 32. That is, although the moment when a necessary amount of the needle thread 32 is drawn out by the motion of the needle bar 12 coincides substantially with a moment when the eye 48 of the needle 10 arrives at the surface of the bed, since the needle thread clamping device 36 clamps the needle thread 32 upon the arrival of the eye 48 of the needle 10 at the middle of the thickness of the work fabric 37 when the work fabric 37 has a large thickness, more needle thread 32 needs to be supplied as the needle bar 12 moves further downward. However, since the take-up lever 42 is held at the uppermost position until the eye 48 of the needle 10 arrives at the surface of the bed, the tension of the needle thread 32 increases inevitably for a moment after the needle thread 32 has been clamped by the needle thread clamping device 36. Normally, the increment of the tension is absorbed by the extension of the needle thread 32, however, when the needle thread 32 is not very extendable it is possible that the needle thread 32 is broken. In such a case, the spring arm 58 functions properly to supplement the needle thread 32 so that the rise in the tension is mitigated. Although the first embodiment has been described hereinbefore with reference to the related drawings, the following modifications are possible in the first embodiment.

In the first embodiment, the take-up lever 42 starts moving downward upon the arrival of the eye 48 of the needle 10 at the surface of the bed. However, it is possible, for example, to shift the phase of start of the downward motion of the take-up lever according to the thickness of the work fabric 37 similarly to the shift of the phase of the needle thread clamping motion of the needle thread clamping device 36.

Furthermore, although the phase of the needle thread releasing motion of the needle thread clamping device 36 coincides with the phase of start of the feed motion of the feed dog 9 for feeding the work fabric 37 in the first embodiment, the phase of the needle thread releasing motion of the needle thread clamping device 36 may be delayed by a fixed angle of rotation of the arm shaft 22 with respect to the phase of start of the feed motion of the feed dog 9. Delaying the phase of the needle thread releasing motion affects favorably to tightening a stitch. The shift of the phase of the needle thread releasing motion of the needle thread clamping device 36 relative to those of the coincidental motions reduces noises.

Furthermore, in the first embodiment, the phases of the needle thread clamping operation and needle thread releasing operation of the needle thread clamping device 36 is regulated according to the thickness of the work fabric 37 by connecting the control plate 68 through the first link 74 and the second link 76 to the presser bar 26. However, it is also possible to regulate the phases of the needle thread clamping operation and needle thread releasing operation of the needle thread clamping device 36 by varying the operating position of the control plate 68 by a driving device on the basis of the output signal of an electric thickness detector for electrically detecting the thickness of the work fabric 37, according to the predetermined relation between the thickness of the work fabric and the optimum phase of operation of the needle thread clamping device.

Still further, an electrically or mechanically driven auxiliary take-up lever for temporarily supplementing the needle thread 32 at the start of the needle thread clamping operation of the needle thread clamping device 36 may be employed instead of the spring arm 58.

Second Embodiment (FIGS. 7 to 19):

Constitution, Function and Effect

In a second embodiment, the supply of the needle thread is controlled according to the thickness of the needle thread instead of the thickness of the work fabric as in the first embodiment.

Figure 7:
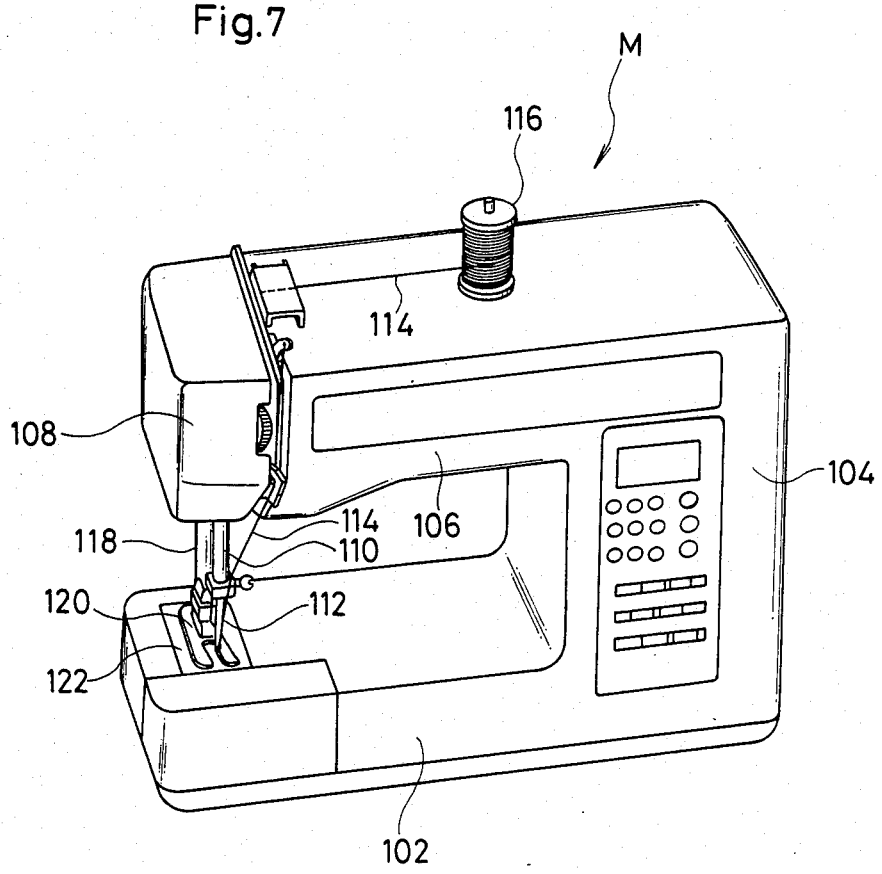
FIG. 7 is a schematic perspective view of a sewing machine incorporated a second embodiment of the present invention.

FIG. 7 illustrates an electronic lock stitch sewing machine M incorporating a second embodiment of the present invention. Illustrated in FIG. 7 are a bed 102, a standard 104 extending upright from the right end of the bed 102, and an arm 106 horizontally extending from the upper end of the standard 104, overhanging the bed 102 and having a head 108 at the left end thereof. A needle bar 110 and a presser bar 118 are provided in the head 108. A needle 112 is attached to the lower end of the needle bar 110. The needle bar 110 is driven for vertical reciprocatory motion and for lateral jogging motion by the arm shaft 128 of the sewing machine. A presser foot 120 is attached to the lower end of the presser bar 118. The presser bar 118 is raised or lowered by means of an operating member (not shown).

A throat plate 122 is provided on the bed 102, and a feed dog 123 is provided in the bed 102 so as to be moved upward through slots formed in the throat plate 122 by a feed mechanism. Predetermined stitches are formed in a work fabric through the cooperative operation of the needle bar 110 and the feed mechanism including the feed dog 123. Since the feed mechanism is of an ordinary known constitution, the description thereof will be omitted.

Figure 8:
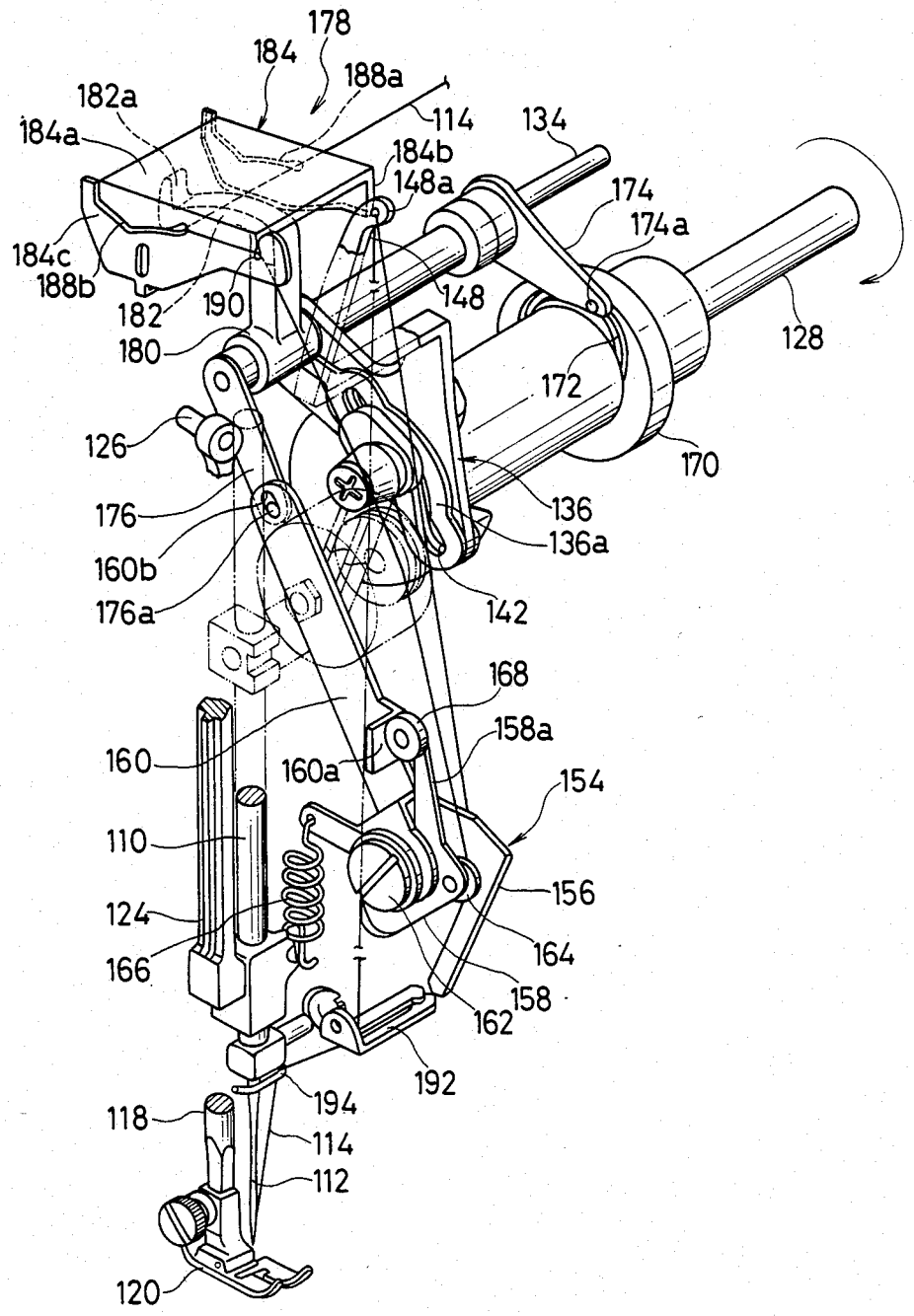
FIG. 8 is a perspective view of the essential portion of the internal mechanism built in the head of the sewing machine of FIG. 7.
Figure 9:
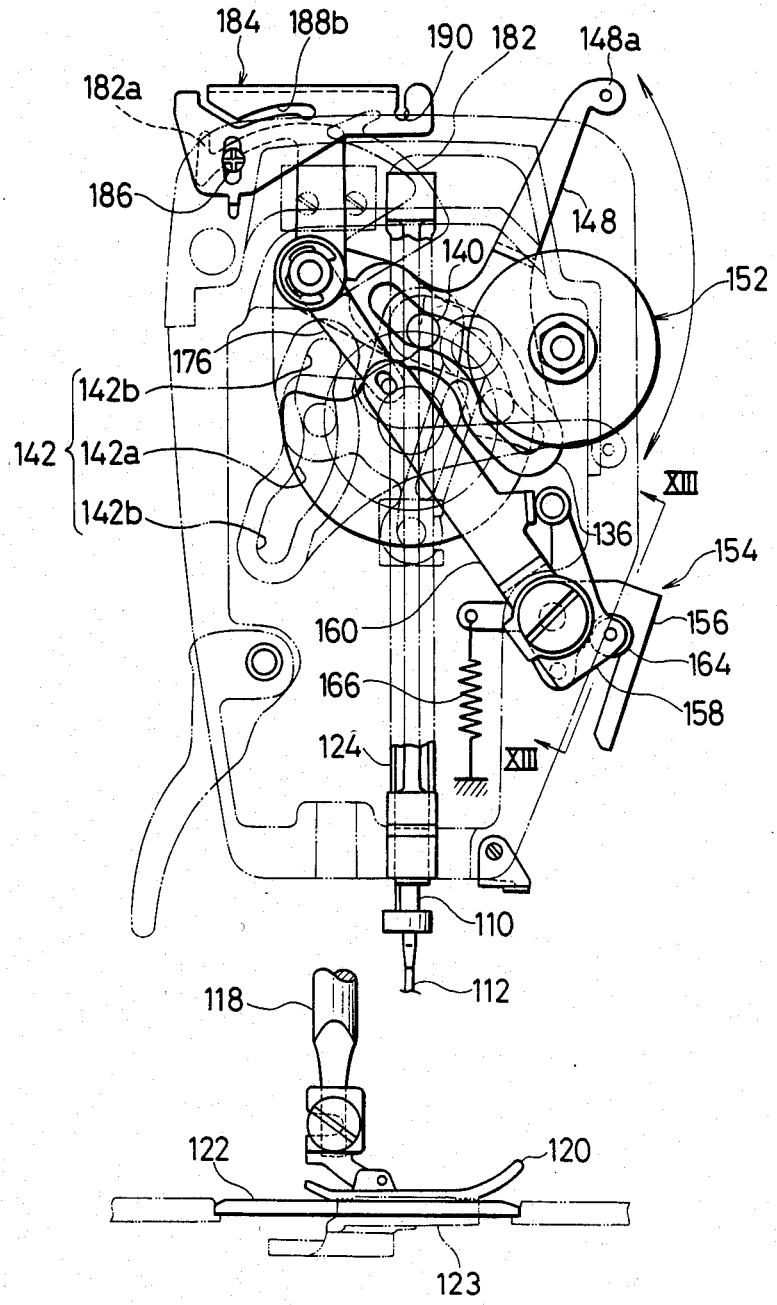
FIG. 9 is a side elevation of the internal mechanism of FIG. 8.
Figure 10:
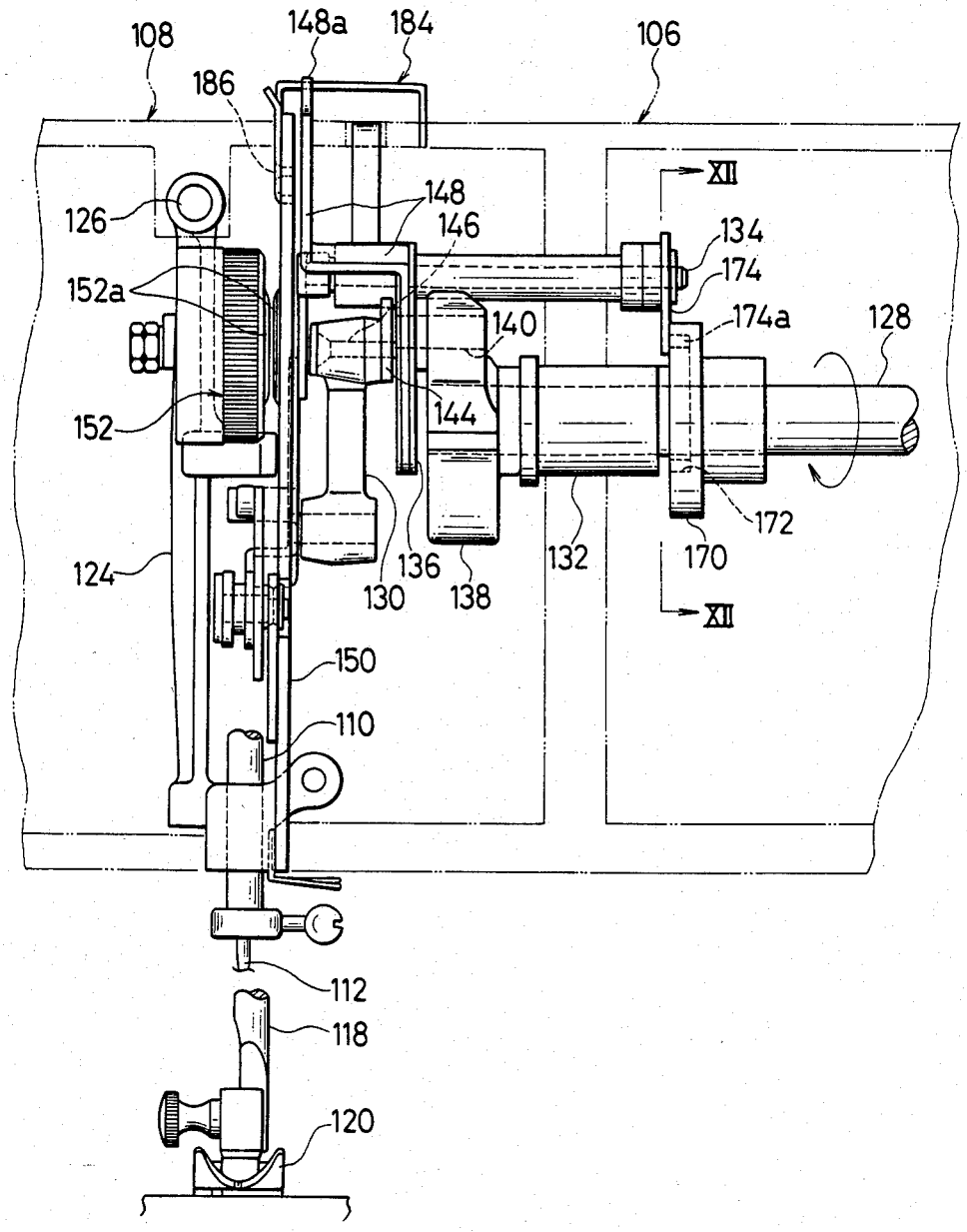
FIG. 10 is a front elevation of the internal mechanism of FIG. 8.

FIGS. 8 to 10 illustrate internal mechanisms disposed within the head 108 and part of the arm 106 near the head 108 of the sewing machine M.

As illustrated in FIGS. 8 to 10, the needle 112 is attached to the lower end of the needle bar 110, while the needle bar 110 is supported vertically movably by a needle bar support 124. The needle bar support 124 is supported pivotally at the upper end thereof with a pin 126 on the frame so as to jog laterally. The needle bar 110 is driven by the arm shaft 128 and a needle bar crank 130 secured to the free end of the arm shaft 128 for vertical motion relative to the needle bar support 124.

The presser foot 120 is attached detachably to the lower end of the presser bar 118, while the presser bar 118 is secured to the frame by a mechanism (not shown) so as to be moved between an upper position and a lower position. When the presser bar 118 is moved to the lower position, the presser foot 120 presses a work fabric against the throat plate 122.

A take-up lever mechanism will be described hereinafter with reference to FIGS. 8 to 10.

The arm shaft 128 is supported rotatably in a bearing bush 132 or the like on the frame. An auxiliary shaft 134 is disposed above and behind the arm shaft 128 so as to extend in parallel to the same. The auxiliary shaft 134 is journaled on the frame. A swing lever 136 is supported swingably at one end thereof on the auxiliary shaft 134. The swing lever 136 extends from the auxiliary shaft 134 to the left side of a take-up lever crank 138 fixedly mounted on the arm shaft 128. The crank pin 140 of the take-up lever crank 138 extends through a slot cam 142 formed in the swing lever 136. A connecting plate 144 is fixed to the left end of the crank pin 140. The needle bar crank 130 is connected rotatably to the connecting plate 144 with a pin 146 extending leftward from the connecting plate 144. The needle bar crank 130 is connected at the lower end thereof to the middle part of the needle bar 110.

The upper part of the swing lever 136 is bent in a zigzag shape to form a take-up lever 148 (take-up member) which extends upward. A thread guide hole 148*a* is formed at the free end of the take-up lever 148.

As illustrated in FIGS. 8 and 9, the slot cam 142 of the swing lever 136 consists of a circular arc section 142*a* having a radius of curvature coinciding with the radius of the circular locus of the crank pin 140 and permitting the rotation of the crank pin 140 through an angle of approximately 74° in a range about the uppermost position of the crank pin 140, and short straight sections 142*b* extending from the opposite ends of the circular arc section 142*a*, respectively. The slot cam 142 is reinforced along the periphery thereof with a reinforcement 136*a*.

When the take-up lever crank 138 and the crankpin 140 are turned around the arm shaft 128 with the crankpin 140 engaging the slot cam 142 of the swing lever 136, the swing lever 136 is driven for reciprocatory swing motion about the auxiliary shaft 134 between an uppermost position indicated by continuous lines (FIG. 9) and a lowermost position indicated by imaginary lines (FIG. 9) by the crankpin 140, while the needle bar 110 is driven for vertical reciprocatory motion through the needle bar crank 130 and the crankpin 140 by the arm shaft 128 in phase with the arm shaft 128.

Figure 11:
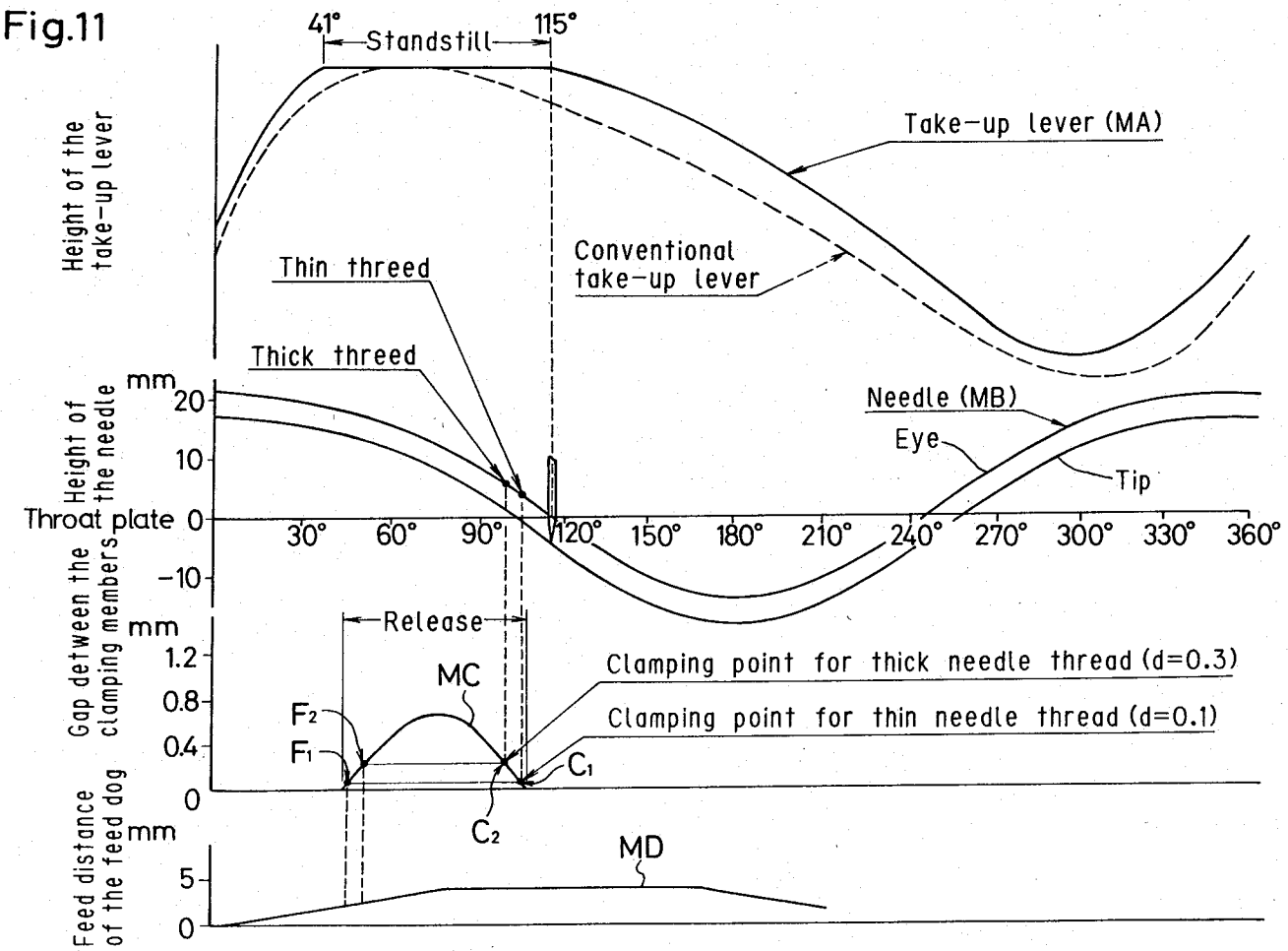
FIG. 11 is a time chart showing the respective motions of the mechanisms of the sewing machine of FIG. 7.
Figure 12:
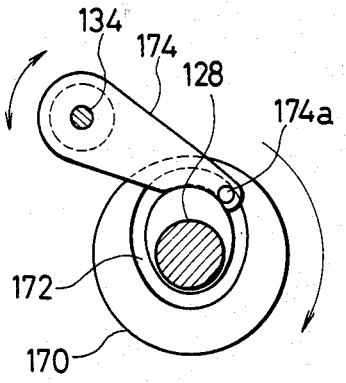
FIG. 12 is a sectional view taken on line XII—XII in FIG. 10.

Since the slot cam 142 of the swing lever 136 has the circular arc section 142*a*, the take-up lever 148, the needle 112 attached to the lower end of the needle bar 110 and the feed dog 123 of the feed mechanism perform motions represented by motion curves MA, MB and MD as functions as the phase angle of the arm shaft 128 as a parameter in FIG. 11, respectively.

The take-up lever 148 is held at the uppermost position from a time after the arm shaft 128 has turned through an angle of approximately 40° from the start of the feed motion to a time when the eye of the needle 112 arrives at the upper surface of the throat plate 122. Accordingly, the take-up lever 148 is held at the upper most position substantially during the feed motion except the initial stage of the feed motion. The swing lever 136 may be designed so that the take-up lever 148 is held at the upper most position from the start of the feed motion. In either case, the swing lever 136 of the second embodiment is comparatively simple in construction and is able to operate smoothly and silently.

A thread supply control mechanism will be described hereinafter with reference to FIGS. 8 to 13.

A plate member 150 forming part of the frame is disposed near and on the lefthand side of the needle bar crank 130 disposed on the lefthand side of the arm shaft 120. The plate member 150 extends at right angles to the arm shaft 128. As illustrated in FIGS. 8 and 9, a pre-tension device 152 for exerting a tension to the needle thread 114 is provided, when necessary, on the left side of the plate member 150 slightly before the arm shaft 128.

The pre-tension device 152 has a pair of tension discs 152*a* which exert a tension to the needle thread passing therebetween. The tension of the needle thread is adjusted by regulating spring force applied to the tension discs 152*a* by operating a dial. The pre-tension device 152 may be omitted.

A thread supply control device 154 which clamps or releases the needle thread 114 in synchronism with the rotation of the arm shaft 128 is provided in a thread path between a thread supply spool 116 and the thread guide hole 148*a* of the take-up lever 148. The thread supply control device 154 comprises a thread guide plate 156, and a swing lever 158 provided with a thread clamping wheel 164. The thread guide plate 156 (thread clamping member) is secured to the left side of the plate member 150 at a position below the pre-tension device 152. The swing lever 158 is disposed adjacent to the left side of the thread guide plate 156 and is pivotally attached to the plate member 150 with a hinge screw 162. A link plate 160 also is pivotally attached at the lower end thereof to the plate member 150 with the hinge screw 162. The thread clamping wheel 164 (thread clamping member) held on the swing lever 158 engages the thread clamping edge 156*a* of the thread guide plate 156 to clamp the needle thread 114 between the thread clamping edge 156*a* and the thread clamping wheel 164. The swing lever 158 is biased resiliently by a spring 166 having one end connected to the frame and the other end connected to the swing lever 158 so that the thread clamping wheel 164 is pressed against the thread clamping edge 156*a*. A contact wheel 168 attached to the upper end of the arm 158*a* of the swing lever 158 is in contact with the front surface of a contact lug 160*a* formed near the lower end of the link plate 160.

Figure 13:
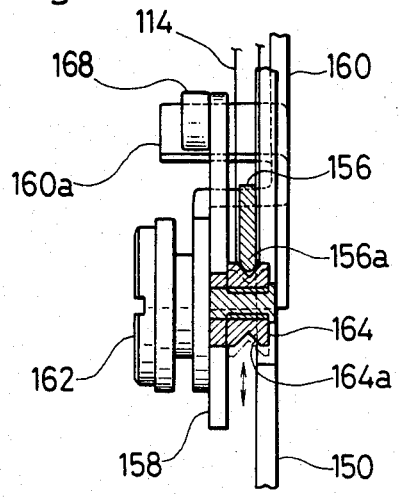
FIG. 13 is a sectional view taken on line XIII—XIII in FIG. 9.

As illustrated in FIGS. 8, 9 and 13, an annular V-shaped groove 164*a* is formed in the circumference of the thread clamping wheel 164, while the thread clamping edge 156*a* of the thread guide plate 156 is formed in a U-shaped curve opening downward in a side view and in a U-shape in section. The V-shaped groove 164*a* of the thread clamping wheel 164 and the U-shaped thread clamping edge 156*a* of the thread guide plate engage to clamp the needle thread 114 therebetween.

After passing the pre-tension device 152, the needle thread 114 is turned by the U-shaped thread clamping edge 156*a* of the thread guide plate 156, and is guided via the thread guide hole 148*a* of the take-up lever 148 to the needle 112. When the thread clamping edge 156*a* and the V-shaped groove 164*a* are engaged, the needle thread 114 is clamped firmly between the thread clamping edge 156*a* and the V-shape groove 164*a* at two points. Particularly, since the thread clamping wheel 164 is moved in parallel to a plane including the thread supply path returned at the thread clamping edge 156*a* and the thread clamping wheel 164 clamps the needle thread 114 across the same, a very high clamping pressure is applied the the needle thread 114. That is, if the thread clamping wheel 164 is pressed with a small force against the thread clamping edge 156*a*, the needle thread 114 can firmly be clamped.

To drive the thread clamping wheel 164 in phase with the rotation of the arm shaft 128 at a speed proportional to the rotating speed of the arm shaft 128 toward and away from the thread clamping edge 156*a* to clamp and release the needle thread 114 alternately at predetermined phase angles of the arm shaft 128, a rotary cam 170 (proportional control means) having an elliptic cam groove 172 is fixedly mounted on the arm shaft 128 at a position opposite the right end of the auxiliary shaft 134, and a cam follower 174*a* attached to the free end of a first arm 174 engages the cam groove 172.

On the other hand, a second arm 176 is fixedly mounted to the auxiliary shaft 134 at the left end of the same. A pin 176*a* attached to the free end of the second arm 176 is received in a slot 160*b* formed in the upper end of the link plate 160 to interconnect the second arm 176 and the link plate 160.

In the abovementioned thread supply control device 154, when the arm shaft 128 is rotated to swing the first arm 174 by the elliptic cam groove 172 of the rotary cam 170, the link plate 160 is reciprocated through the auxiliary shaft 134 and the second arm 176 on the hinge screw 162.

When the contact wheel 168 is pushed forward by the contact lug 160*a* of the link plate 160 as the link plate 160 is driven by the second arm 176, the swing lever 158 is turned against the resilient force of the spring 166, so that the thread clamping wheel 164 is separated from the thread clamping edge 156*a* of the thread guide plate 156 to release the needle thread 114. When the contact lug 160*a* of the link plate 160 is moved backward, the swing lever 158 is turned in the opposite direction by the spring 166, so that the thread clamping wheel 164 engages the thread clamping edge 156*a* to clamp the needle thread 114. Thus, the needle thread 114 is clamped and released alternately at predetermined phase angles, respectively. The needle thread clamping and releasing motion is represented by a motion curve MC in FIG. 11.

As in apparent from FIG. 11, during the upward movement of the take-up lever 148 from the lowermost position to the uppermost position for tightening the needle thread 114, the needle thread 114 is clamped between the thread guide plate 156 and the thread clamping wheel 164 so that the needle thread 114 is surely tightened. After the needle thread 114 has completely been tightened, the swing lever 158 is driven in phase with the feed motion to release and supply the needle thread 114. While the needle thread 114 is thus released free, the feed motion and the needle jogging motion are accomplished, and then the needle thread 114 is clamped again before the needle 112 arrives at the throat plate 122. While the needle thread 114 is clamped, the stitching motion is carried out to form a needle thread loop by the shuttle. Accordingly, the needle thread of an amount necessary for feeding the work fabric and for jogging the needle 112 is surely supplied, while the needle thread 114 is not supplied uselessly while a loop of the needle thread 114 is formed, because the needle thread 114 is clamped during the loop forming period.

As is apparent from the motion curve MC shown in FIG. 11, owing to the needle thread clamping characteristics determined by the shape of the elliptic cam groove 172 of the rotary cam 170, when the thickness of the needle thread 114 is small, the needle thread 114 is released and is clamped at a point $F_1$ and at a point $C_1$, respectively. When the thickness of the needle thread 114 is large, the needle thread 114 is released at a point $F_2$ after the point $F_1$, and is clamped at the point $C_2$ before the point $C_1$. Accordingly, thin needle threads and thick needle threads are tightened properly at a low tension and at a high tension, respectively.

Since the cam groove 172 of the rotary cam 170 serving as the proportional control means has an elliptic can surface, the respective speed of the upward swing and downward swing of the first arm 174 are proportional to the rotating speed of the arm shaft 128, so that the needle thread clamping wheel 164 is moved toward and away from the thread clamping edge 156*a* at a speed proportional to the rotating speed of the arm shaft 128. Thus, a substantially fixed amount of the needle thread 114 is supplied in every stitching cycle regardless of the rotating speed of the arm shaft 128, and hence the tension of the needle thread in forming stitches is not affected by the stitching speed.

A needle thread supply mechanism 178 which draws out the needle thread 114 from the thread supply spool 116 by a predetermined amount and stores the same while the take-up lever 148 is moved downward and the needle thread 114 is clamped between the needle thread clamping wheel 164 and the needle thread guide plate 156 will be described hereinafter with reference to FIGS. 8 to 10.

A sleeve 180 is fitted rotatably on the auxiliary shaft 134 near a position where the auxiliary shaft 134 supports the swing lever 136 at one end, and the end of the swing lever 136 on the auxiliary shaft 134 is fixed to the sleeve 180. An L-shaped arm 182 having a thread catching hook 182*a* at the free end thereof is fixed to the sleeve 180. A thread guide member 184 substantially of a U-shape in front view is disposed on top of the left end of the arm 106 of the sewing machine M. The thread guide member 184 has a top wall 184*a*, a first guide wall 184*b* and a second guide wall 184*c*. The first guide wall 184*b* and the second guide wall 184*c* extend vertically downward from the opposite sides of the top guide wall 184*a*, respectively. The second guide wall 184*c* of the thread guide member 184 is fixed to the upper end of the plate member 150 with a screw 186. The thread guide member 184 is disposed near and above the L-shaped arm 182. The first guide wall 184*b* and the second guide wall 184*c* are disposed opposite to each other with a predetermined distance therebetween. A first guide slit 188*a* and a second guide slit 188*b* are formed laterally opposite to each other in the first guide wall 184*b* and the second guide wall 184*c*, respectively. The respective rear ends of the first guide slit 188*a* and the second guide slit 188*b* are open to receive the needle thread 114 therein. A third guide slit 190 is formed in the upper part of the front end of the second guide wall 184*c*.

The needle thread 114 pulled out from the thread supply spool 116 is extended sequentially through the first guide slit 188*a*, the second guide slit 188*b*, along the left side of the second guide wall 184*c*, via the third guide slit 190, the pre-tension device 152, the thread clamping edge 156*a* of the thread guide plate 156, where the needle thread 114 is returned upward, and then further through the thread guide hole 148*a* of the take-up lever 148, and thread guides 192 and 194 to the eye of the needle 112.

Both the L-shaped arm 182 and the swing lever 136 are fixed to the sleeve 180, and hence the L-shaped arm 182 and the swing lever 136 are driven for swing motion by the take-up lever crank 138 in phase with the rotation of the arm shaft 128. As illustrated in FIG. 9, while the take-up lever 148 is held at the uppermost position as indicated by continuous lines, the L-shaped arm 182 is located, as indicated by dotted lines, behind the needle thread 114 passing the respectively front ends of the first guide slit 188*a* and the second guide slit 188*b*. On the other hand, when the take-up lever 148 is moved downward the lowermost position as indicated by imaginary lines, the swing lever 136 swings on the auxiliary shaft 134 and the L-shaped arm 182 swings forward as indicated by imaginary lines on the auxiliary shaft 134, so that the thread catching hook 182*a* is moved forward and engages the needle thread 114 extending between the respective front ends of the first guide slit 188*a* and the second guide slit 188*b*, and thereby the needle thread 114 is pulled by the thread catching hook 182*a* by a predetermined distance. Since the needle thread 114 is clamped between the thread clamping wheel 164 and the thread guide plate 156 while the needle thread 114 is pulled by the thread catching hook 182*a*, a predetermined amount of the needle thread is surely pulled out from the thread supply spool 116.

Thus, while the take-up lever 148 is located at the lowermost position, the needle thread 114 is pulled out from the thread supply spool 116 by the L-shaped arm 182 of the needle thread supply mechanism 178, so that the needle thread 114 between the thread supply spool 116 and the thread clamping edge of the thread guide plate 156 is slackened. After the needle thread 114 has thus been slackened, the take-up lever 148 is moved upward to tighten the needle thread 114, then the needle thread 114 is released from the restrain of the thread guide plate 156 and the thread clamping wheel 164, and then the needle thread 114 of a necessary amount is supplied via the take-up lever 148 to the needle 112 as the feed dog 123 performs the feed motion and the needle 112 is jogged.

Although the feed motion of the feed dog 123 is started before the needle thread 114 is released, the amount of the needle thread 114 required for such a mode of feed motion is supplemented by the elastic extension of the needle thread 114, and the needle thread 114 is recovered from the elastic extension as the same is supplied after being released.

Thus, the phases of the needle thread clamping and releasing operations are controlled automatically according to the thickness of the needle thread 114, and the needle thread 114 of a necessary amount dependent on the feed stroke and the needle jogging stroke is surely supplied for every stitching cycle. Accordingly, an optimum tension according to the thickness of the needle thread 114 is exerted to the needle thread 114.

Figure 14:
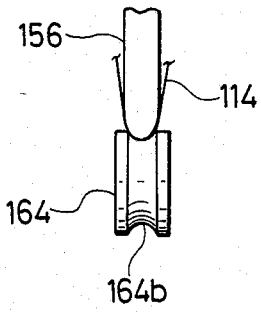
FIGS. 14 to 17 are schematic illustrations showing modifications of the thread clamping members shown in FIG. 13.
Figure 15:
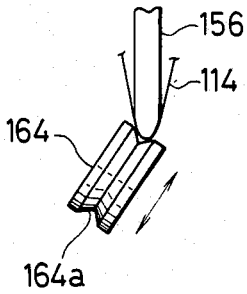
Figure 16:
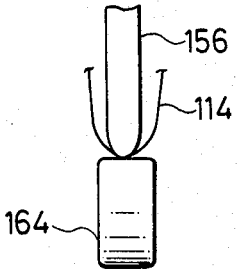
Figure 17:
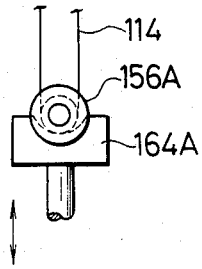

In the thread supply control device 154, a U-shaped groove 164*b* may be formed in the circumference of the thread clamping wheel 164, as illustrated in FIG. 14, the thread clamping wheel 164 may be moved obliquely relative to the thread guide plate 156 as illustrated in FIG. 15, or the needle clamping wheel 164 may have a cylindrical circumference as illustrated in FIG. 16. Furthermore, although not shown, a member secured to the swing lever 158 may be employed instead of the thread clamping wheel 164. Still further, it is also possible to employ a grooved free wheel 156A instead of the thread clamping edge 156*a*. When the free wheel 156A is employed, the needle thread 114 is wound around the half of the circumference of the free wheel 156A, and a clamping member 164A substituting the thread clamping wheel 164 is brought into point-contact with the circumference of the free wheel 156A to clamp the needle thread as illustrated in FIG. 17.

Figure 18:
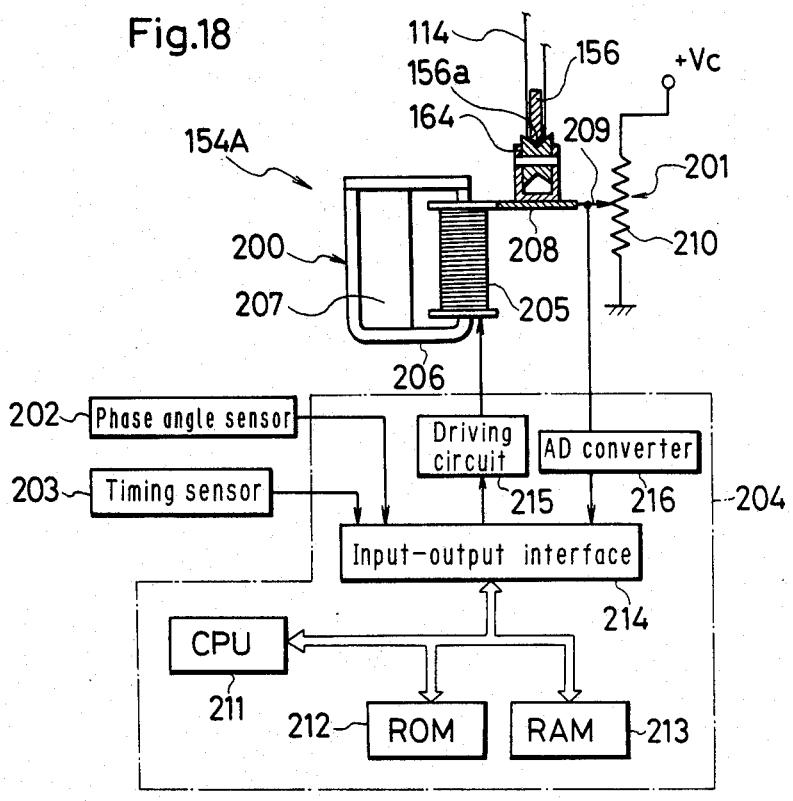
FIG. 18 is block diagram showing the electrical constitution of a modification of the thread passage control unit of the second embodiment.

A modification of the thread supply control device will be described hereinafter with reference to FIG. 18 and FIG. 19.

The thread supply control device 154A comprises the thread clamping wheel 164, a linear actuator 200 for driving the thread clamping wheel 164, a displacement sensor 201 for sensing the displacement of the thread clamping wheel 164, a phase angle sensor 202 for sensing the phase angle of the arm shaft 128, a timing sensor 203, and a control unit 204.

The linear actuator 200 comprises a moving coil 205 connected to the thread clamping wheel 164, a metallic frame 206 vertically movably retaining the moving coil 205 and forming a magnetic path, and a permanent magnet 207 forming a uniform magnetic field around the moving coil 205. The vertical position of the moving coil is determined according to the intensity of current supplied to the moving coil 205.

The displacement sensor 201 is a potentiometer comprising a contact 209 connected to the thread clamping wheel supporting member 208 of the moving coil 205, and and electric resistor 210 connected to a reference voltage line.

The phase angle sensor 202 comprises, for example, a disc have a plurality of slits formed along the circumference thereof at regular angular intervals and fixed to the arm shaft 128, and a photoelectric detector comprising a light emitting element and a light receiving element for detecting the slits.

The timing sensor 203 is a limit switch or a contactless switch which detects the arrival of the needle bar 110 at the upper most position.

The control unit 204 comprises a central processing unit (hereinafter abbreviated to "CPU") 211, a read-only memory (ROM) 212, a random access memory (RAM) 213, an input-output interface 214, a driving circuit 215 which receives control signals through the input-output interface 214 from the CPU 211 and supplies a driving current corresponding to the input signal to the moving coil 205, and an AD converter 216 which converts an analog detection signal of the displacement sensor 201 into a digital signal corresponding to the analog detection signal and gives the same to the input-output interface 214. The detection signals of the phase angle sensor 202 and the timing sensor 203 are given through the input-output interface 214 to the CPU 211. The input-output interface 214, the ROM 212 and the RAM 213 are connected through an address bus and a data bus to the CPU 211.

The ROM 212 pre-stores a control program for controlling the linear actuator 200 in accordance with a timing signal $S_1$ given by the timing sensor 203, a phase angle signal $S_2$ given by the phase angle sensor 202 and a displacement signal given by the displacement sensor 201 to regulate the gap between the thread clamping wheel 164 and the thread clamping edge 156*a* of the thread guide plate 156.

Since the mode of controlling the linear actuator 200 is comparatively simple, the same will be described characteristically hereinafter.

Figure 19:
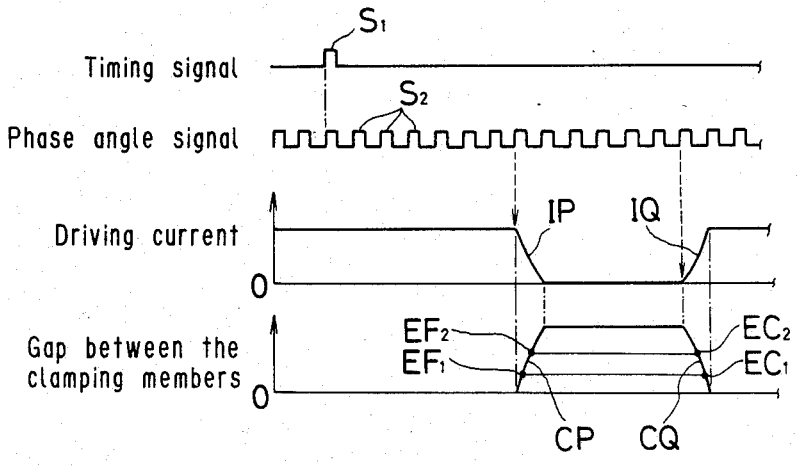
FIG. 19 is a time chart showing the variation of the gap of the thread path in relation to a timing signal and a phase signal and the variation of the solenoid driving current in the modification shown in FIG. 18.

Referring to FIG. 19, a predetermined current is supplied to the moving coil 205 until a predetermined number of phase angle signals $S_2$ are given to the CPU 211 after a timing signal $S_1$ has been given to the CPU 211, and thereby the thread clamping wheel 164 is held in contact with the thread clamping edge 156*a* to clamp the needle thread 114 therebetween.

Upon the reception of the predetermined number of phase angle signals $S_2$, the CPU 211 controls the driving circuit 215 so as to reduce the driving current at a rate corresponding to the rotating speed of the arm shaft 128 as represented by a curve IP; consequently, the moving coil 205 is lowered gradually to increase the gap between the thread clamping wheel 164 and the thread clamping edge 156*a* as represented by a curve CP.

The rotating speed of the arm shaft 128 is determined through computation on the basis of the phase angle signals $S_2$. Various CP curves for various rotating speeds are stored as a memory map in the ROM 212. The magnitude of the driving current is controlled momently through feedback control on the basis of the displacement signals given by the displacement sensor 201 in a mode as represented by the curve IP.

Similarly to the manner of control in the foregoing embodiments, the curves CP corresponding to the rotating speed of the arm shaft 128 are stored in the memory map of the ROM 212 to regulate the rate of increasing the gap between the thread clamping wheel 164 and the thread clamping edge 156*a* in proportion to the rotating speed of the arm shaft 128.

The magnitude of the driving current is controlled in the same manner to decrease the gap between the thread clamping wheel 164 and the thread clamping edge 156*a* in clamping the needle thread 114. The timing of driving the moving coil 205 is determined by counting the phase angle signals $S_2$, and then the magnitude of the driving current supplied to the moving coil 205 is regulated through feedback control on the basis of the displacement signals according to a curve IQ so that the gap is decreased along a curve CQ stored in the memory map of the ROM 212.

Similarly to the curve MC for the second embodiment, a thin needle thread is released at a point $EF_1$ and is clamped at a point $EC_1$, while a thick needle thread is released at a point $EF_2$ and is clamped at a point $EF_2$ as shown in FIG. 19.

The linear actuator 200 employed in this embodiment may be substituted by a stepping motor or the like.

What is claimed is:

1. An automatic needle thread supply control system for use in a sewing machine having a needle thread supply source, an endwise reciprocatory needle with an eye, a feed member operating in synchronism with the reciprocation of the needle for imparting a feed motion to a work fabric, a take-up member movable between a first position where the needle thread is slackened to a maximum thread slack amount and a second position where the needle thread is taken up to a maximum thread take-up amount, and a needle thread supply path extending from the needle thread supply source through the take-up member to the eye of the needle, said automatic needle thread supply control system comprising;

thread securing means operative in synchronism with the reciprocation of said needle for securing said maximum thread take-up amount of the needle thread during a specific period which starts at a time determined so as to at least partly overlap with the period of said feed motion and terminates at a time when the eye of said needle is lowered near to the surface of a bed, thread supply stopping means operative to permit and check the supply of the needle thread which is drawn out from said needle thread supply source as said fabric is fed by said feed member, and control means operative in synchronism with the reciprocation of said needle for controlling the timing and the period of operation of said thread supply stopping means according to the thickness of said fabric being sewn or the thickness of the needle thread being used so that said thread supply stopping means permits the supply of the needle thread during said specific period.

2. An automatic needle thread supply control system according to claim 1, wherein said thread securing means includes a swing lever swingably supported on a machine frame and connected to said take-up member, and said swing lever has a slot cam engageable with a crankpin eccentrically connected to a main shaft of said sewing machine and consisting of a circular arc section having a radius of curvature coinciding with the radius of the circular locus of said crankpin and short straight sections extending from the opposite ends of said circular arc section.

3. An automatic needle thread supply control system for use in a sewing machine having a needle thread supply source, an endwise reciprocatory needle with an eye, a feed member operating in synchronism with the reciprocation of the needle for imparting a feed motion to a work fabric, a take-up member movable between a first position where the needle thread is slackened to a maximum thread slack amount and a second position where the needle thread is taken up to a maximum thread take-up amount, and a needle thread supply path extending from the needle thread supply source through the take-up member to the eye of the needle, said automatic needle thread supply control system comprising;

driving means for timing the start of holding said take-up member at said second position so that the period of holding said take-up member at said second position at least partly overlaps with the period of said feed motion, holding said take-up member at said second position until the eye of said needle is lowered near to the surface of a bed, and moving said take-up member in synchronism with the reciprocation of said needle after the eye of said needle has been lowered near to the surface of said bed, thread supply stopping means operative to permit and check the supply of the needle thread which is drawn out from said needle thread supply source as said fabric is fed by said feed member, and control means operative in synchronism with the reciprocation of said needle for controlling the timing and the period of operation of said thread supply stopping means according to the thickness of said fabric being sewn or the thickness of the needle thread being used so that said thread supply stopping means permits the supply of the needle thread while said take-up member is held at said second position.

4. An automatic needle thread supply control system according to claim 3, wherein said driving means includes cam means for holding said take-up member at said second position.

5. An automatic needle thread supply control system according to claim 3, wherein said thread supply stopping means comprises a pair of thread clamping members having clamping surfaces which engage in point contact to surely clamp the needle thread.

6. An automatic needle thread supply control system according to claim 3, wherein said thread supply stopping means comprises a pair of thread clamping members and said control means comprises proportional control means for controlling the speed of at least either a motion for engaging or a motion for disengaging said thread clamping members in proportion to a sewing speed.

7. An automatic needle thread supply control system according to claim 6, wherein said proportional control means includes a cam member operatively connected to a main shaft of said sewing machine.

8. An automatic needle thread supply control system according to claim 6, wherein said proportional control means includes a rotary member operatively connected to a main shaft of said sewing machine, a detector for generating a pulse signal every predetermined angle of rotation of said rotary member, and actuating means for varying the relative position of said thread clamping members in response to said pulse signal at least either in engaging or in disengaging said thread clamping members.

9. An automatic needle thread supply control system according to claim 3, wherein said thread supply stopping means comprises a pair of thread clamping members, and said control means includes cam means operatively connected to a main shaft of said sewing machine, cam follower means engageable with said cam means and operatively connected to one of said thread clamping members, and means for varying the angular position of said cam follower means about said main shaft according to the thickness of said fabric being sewn.

10. An automatic needle thread supply control system according to claim 9, wherein said control means further includes plural links connecting said cam follower means to a presser device for pressing said fabric being sewn.

11. An automatic needle thread supply control system according to claim 1, wherein said thread securing means connects a main shaft which drives said feed member and needle to said take-up member.

12. An automatic needle thread supply control system according to claim 3, wherein said driving means connects a main shaft which drives said feed member and needle to said take-up member.

* * * * *